US009557095B2

(12) United States Patent
Rumble

(10) Patent No.: US 9,557,095 B2
(45) Date of Patent: Jan. 31, 2017

(54) REFRIGERATOR DOOR LOCK

(71) Applicant: RUMBLE PRODUCTS LLC, Elkhart, IN (US)

(72) Inventor: Matthew G. Rumble, Granger, IN (US)

(73) Assignee: Rumble Products, LLC, Elkhart, IN (US)

( * ) Notice: Subject to any disclaimer, the term of this patent is extended or adjusted under 35 U.S.C. 154(b) by 0 days.

(21) Appl. No.: 13/830,170

(22) Filed: Mar. 14, 2013

(65) Prior Publication Data

US 2014/0259958 A1 Sep. 18, 2014

(51) Int. Cl.

| | |
|---|---|
| ***F25D 3/02*** | (2006.01) |
| ***F25D 23/02*** | (2006.01) |
| ***E05C 7/04*** | (2006.01) |
| ***E05B 65/00*** | (2006.01) |
| ***E05C 19/18*** | (2006.01) |
| ***E05B 15/16*** | (2006.01) |

(52) U.S. Cl.

CPC ..... *F25D 23/028* (2013.01); *E05B 15/1607* (2013.01); *E05B 65/0042* (2013.01); *E05C 7/04* (2013.01); *E05C 19/184* (2013.01); *Y10T 292/20* (2015.04)

(58) Field of Classification Search

USPC ..... 49/366, 383, 394; 292/256.71, 256.73, 292/DIG. 71; 312/405, 324

See application file for complete search history.

(56) References Cited

U.S. PATENT DOCUMENTS

| | | | | |
|---|---|---|---|---|
| 2,280,122 | A * | 4/1942 | Hardwick | 292/288 |
| 3,437,365 | A * | 4/1969 | Zadanoff et al. | 292/202 |
| 4,317,516 | A * | 3/1982 | Palmer-Ball, Sr. | 206/320 |
| 5,016,453 | A | 5/1991 | Bonnice et al. | |
| 5,265,921 | A | 11/1993 | Nikitas et al. | |
| D344,442 | S | 2/1994 | Myers | |
| 5,358,293 | A * | 10/1994 | Bradley et al. | 292/288 |
| 6,526,788 | B2 * | 3/2003 | Finkelstein et al. | 70/129 |
| 7,728,711 | B2 | 6/2010 | Shoenfeld | |
| 7,768,378 | B2 | 8/2010 | Hill et al. | |
| 8,063,735 | B2 | 11/2011 | Shoenfeld | |
| 8,199,019 | B2 | 6/2012 | Kaczmarz et al. | |

OTHER PUBLICATIONS

Cedar Creek RV Owner's Club, posts dated Jan. 2012.

* cited by examiner

*Primary Examiner* — Brian Mattei
*Assistant Examiner* — Catherine A Kelly
(74) *Attorney, Agent, or Firm* — Faegre Baker Daniels LLP

(57) ABSTRACT

A refrigerator lock for selectively locking at least one door of a refrigerator into a closed position is described. The refrigerator door lock may include an anchor having an outer periphery sized to fit on a door face of the refrigerator adjacent to one or more doors seals when the door maintains the closed position. A fastener such as an adhesive may be utilized to secure the anchor to the door face of the refrigerator. An extension extends from a catch and is selectively securable to the anchor. With the extension secured to the anchor, the catch overlaps the refrigerator doors and either directly or indirectly engages the refrigerator doors to hold them in the closed position.

20 Claims, 3 Drawing Sheets

REFRIGERATOR DOOR LOCK

BACKGROUND

1. Technical Field

The present disclosure relates to a door lock optionally useable to retain the doors of a refrigerator in a closed position. More specifically, the present disclosure relates to a refrigerator door lock which can be retrofitted to a refrigerator which does not incorporate such a feature.

2. Description of the Related Art

Refrigerators can be incorporated in recreational vehicles and other conveyances such as large water craft. In such an installation, the doors of the refrigerator may be prone to accidently open when the vehicle or water craft is in transit. Accidental opening of the refrigerator doors may be caused by the ability of the refrigerator doors and the refrigerator contents to move relative to the refrigerator frame which is firmly secured to the vehicle or water craft.

In the prior art, various closure devices incorporating locking structures secured to both the refrigerator frame and the door to be secured have been utilized. Also, certain refrigerators incorporate threaded apertures in the door frame, which can be utilized to anchor a catch that engages a closed door to selectively hold the refrigerator door in a closed position. However, the anchor/catch arrangement is not useable with a French door refrigerator or any other refrigerator that doesn't incorporate an integral anchor.

SUMMARY

The present disclosure relates to a refrigerator lock for selectively locking at least one door of a refrigerator into a closed position. In an exemplary embodiment of the present disclosure, the refrigerator lock includes an anchor having an outer periphery sized to fit on a door face of the refrigerator adjacent to one or more door seals when such doors maintain the closed position. A fastener such as an adhesive may be utilized to secure the anchor to the door face of the refrigerator at a selected location. An extension extends from a catch and is selectively securable to the anchor. With the extension secured to the anchor, the catch overlaps the refrigerator doors and either directly or indirectly engages the refrigerator doors to hold them in the closed position.

Because the anchor of the present disclosure is selectively securable in a chosen position, it is retrofitable to any refrigerator and does not require the door face to be drilled or otherwise have an aperture formed therein.

The disclosure, in one form thereof, provides a refrigerator lock for selectively locking at least one door of a refrigerator into a closed position in which a door seal of the at least one door maintains sealing engagement with a door face of the refrigerator and access to an internal compartment for storing cooled items is prevented. In this form of the present disclosure, the refrigerator lock includes an anchor including an outer periphery sized to fit on the door face of the refrigerator adjacent to a seal of the at least one door of the refrigerator when the at least one door of the refrigerator maintains the closed position and the seal of the at least one door engages the door face of the refrigerator. In this form of the present disclosure the anchor includes a refrigerator fastener operable to selectively secure the anchor to the door face of the refrigerator in a chosen position. A catch and an extension extending from the catch is selectively securable to the anchor in a secured position. The catch is sized to overlap the at least one door of the refrigerator when the catch is secured to the anchor and the anchor is secured to the door face of the refrigerator adjacent to the seal of the at least one door when the at least one door of the refrigerator maintains the closed position and the seal of the at least one door engages the door face of the refrigerator, the extension having a length between the catch and the anchor when the extension is secured to the anchor, the length sized so that with the anchor secured to the door face adjacent to the seal of the at least one door and the at least one door of the refrigerator in the closed position and the extension secured to the anchor, the catch engages the at least one door of the refrigerator to hold it in the closed position. In this or any other form of the invention, the engagement of the door with the refrigerator may be either direct or indirect. For example, a towel, sponge, or other soft and resilient material may be positioned between the catch and the refrigerator door.

The disclosure, in another form thereof, provides a method of securing the doors of a refrigerator against opening, the method of this form of the present disclosure comprises: securing an anchor to the refrigerator so that the anchor is adjacent to a seal of the at least one door of the refrigerator when the at least one door of the refrigerator maintains a closed position in which a door seal of the at least one door maintains sealing engagement with a door face of the refrigerator and access to an internal compartment for storing cooled items is prevented; and securing a catch to the anchor so that, with the at least one door of the refrigerator maintaining the closed position, the catch overlaps the at least one door of the refrigerator and engages at least one door of the refrigerator to hold it in the closed position, the catch secured relative to the at least one door of the refrigerator solely by way of its securement to the anchor.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
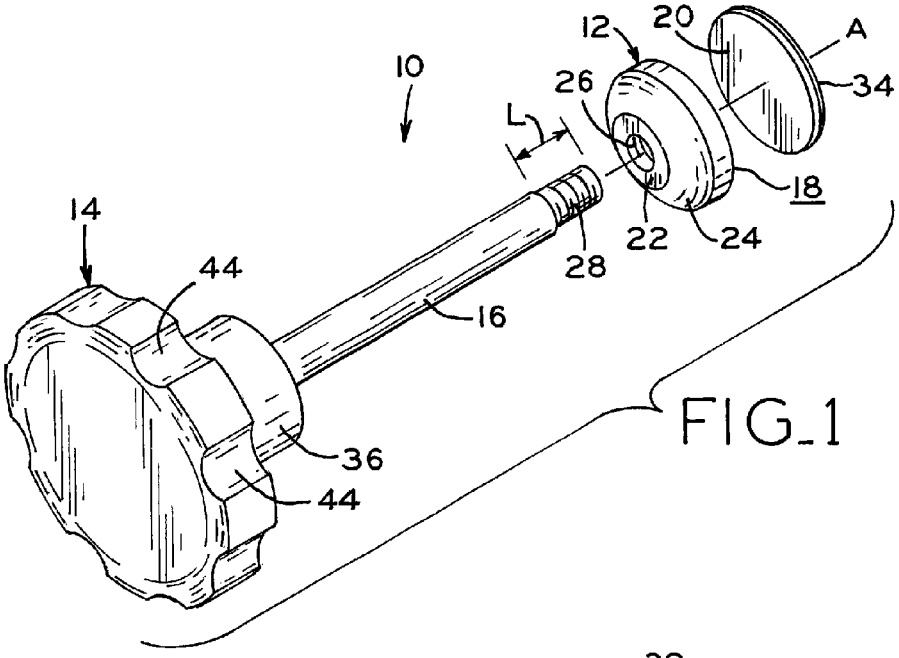
FIG. 1 is a perspective, exploded view of an exemplary refrigerator door lock of the present disclosure.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DETAILED DESCRIPTION OF THE PRESENT INVENTION

Referring to FIG. 1, refrigerator door lock 10 includes anchor 12 and catch 14 having extension 16 extending therefrom. Anchor 12 includes distal surface 18 to which double sided adhesive 20 is secured. Anchor 12 tapers from distal surface 18 to proximal surface 22. In the exemplary embodiment illustrated, tapering from a distal surface 18 to proximal surface 22 follows an arcuate path to define domed portion 24 of anchor 12. In alternative embodiments, tapering of anchor 12 may be linear so that domed portion 24 comprises a conical portion.

Anchor 12 includes threaded elongate aperture 26 traversing proximal surface 22 and extending into the body of anchor 12. Extension 16 includes distal threaded end 28. Distal threaded end 28 of extension 16 and threaded elongate aperture 26 of anchor 12 include compatible threads such that extension 16 may be threadedly engaged with anchor 12. In one exemplary embodiment, length L of distal threaded end 28 (measured along the longitudinal axis of extension 16) is no longer than a height measured from distal surface 18 to proximal surface 22 of anchor 12. In certain embodiments, length L of distal threaded end 28 may be less than the height of anchor 12. If length L of threaded distal end 28 is less than the height of anchor 12 and threaded elongate aperture 26 spans the entire height of anchor 12, then a shoulder formed proximate of distal threaded end 28 can bottom out on proximal surface 22 of anchor 12 when extension 16 is fully threadedly engaged with anchor 12. In such an embodiment in which a shoulder proximate of distal threaded end 28 bottoms out on proximal surface 22 of anchor 12, this frictional engagement will provide further frictional resistance to detachment of extension 16 and therefore catch 14 from anchor 12. Further, a lock washer may be interposed between such a shoulder and proximal surface 22 of anchor 12.

Figure 5:
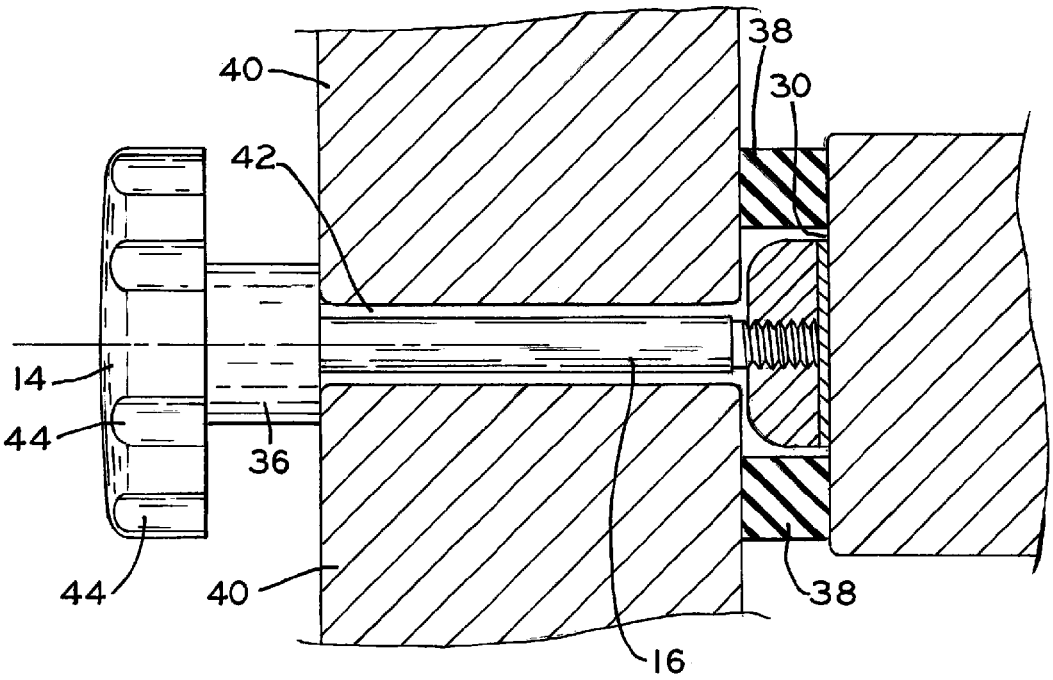
FIG. 5 is a sectional view taken along line 5-5 of FIG. 4.

In an exemplary embodiment, distal surface 18 of anchor 12 defines a circular periphery having a diameter of about 1⅜ inches. The diameter of anchor 12 may also be 1³⁄₁₆ inches. Anchor 12 will be sized so that it can be positioned between adjacent seals 38 of adjacent doors 40 of refrigerator 32 as described in detail below. Anchor 12 can have a height measured between distal surface 18 and proximal surface 22 of about ⁷⁄₁₆ inches. The height of anchor 12 may also be 0.39 inches. Such heights allows anchor 12 to be interposed between door face 30 of refrigerator 32 and doors 40, when doors 40 are placed in the closed position. Such an arrangement is illustrated in FIG. 5 and further described below.

In embodiments of the present disclosure, extension 16 may have a total length extending from boss 36 of catch 14 to the distal most end of distal threaded end 28 of about 3 inches. In alternative embodiments, the length of extension 16 extending from boss 36 is about 1.875 inches. Such lengths allow extension 16 to secure catch 14 relative to the doors of a refrigerator as further described herein. In embodiments of the present disclosure, extension 16 comprises a cylindrical extension having a diameter of about ⅜ inch, with a proximal end having a thread with a ⅜ inch major diameter and 16 threads per inch pitch extending for a length of 0.625 inches for threaded engagement with catch 14. The distal end of the ⅜ inch diameter extension includes a thread with a ⁵⁄₁₆ inch major diameter and 18 threads per inch pitch extending for a length of 0.375 inches for threaded engagement with a complementary female thread in anchor 12. This distal thread size allows the unthreaded length of extension 16 adjacent to the distal thread to form a shoulder that bottoms out on a proximal surface of anchor 12, as the distal end of extension 16 is threaded into a corresponding ⁵⁄₁₆-18 female thread in anchor 12.

In alternative embodiments, extension 16 may have a polygonal cross-section, e.g., a hexagonal cross-section perpendicular to a longitudinal axis of the extension throughout the length of the extension. In an exemplary embodiment, the head of catch 14 defines a generally circular perimeter perpendicular to a longitudinal axis of the catch. In one exemplary embodiment, catch 14 has a circular outer periphery defining a diameter of approximately 2½ inches. The outer diameter of catch 14 is measured to its radial outward most extent.

In certain exemplary embodiments, anchor 12 is formed of steel, such as a mild steel or hardened steel. Anchor 12 may be formed of stainless steel, e.g., 304 Stainless Steel. Extension 16 may similarly be formed of a steel such as a mild steel or a hardened steel, while catch 14 may be formed of a hardened plastic or any of a variety of polymers including, e.g., various polyethylenes. In construction, extension 16 may be threadedly engaged with boss 36 of catch 14. Alternatively, a liquid adhesive may be inserted into a longitudinal aperture formed in boss 36 and extension 16 may thereby be secured to catch 14.

In construction, double sided adhesive 20 is secured to distal surface 18 of anchor 12 with the opposite side of double sided adhesive 20 having backing 34 removably secured thereto. In use, backing 34 will be removed to allow double sided adhesive 20 to be utilized to secure anchor 12 to door face 30 of refrigerator 32 as further described below. In one exemplary embodiment, double sided adhesive 20 comprises GASKA Hi BOND® SERIES double sided adhesive tape available from Gaska Tape Inc. of Elkhart, Ind. Double sided adhesive 20 is, in exemplary embodiments thereof, a double sided adhesive tape having either a foamed acrylic core or a solid acrylic core that is coated on both sides with high performance acrylic adhesives. In exemplary embodiments, double sided adhesive 20 has a T block Tensile Adhesion according to the QA3012 test method of 120 psi and an Adhesive Peel of 12 psi according to ASTM D-1000.

Figure 2:
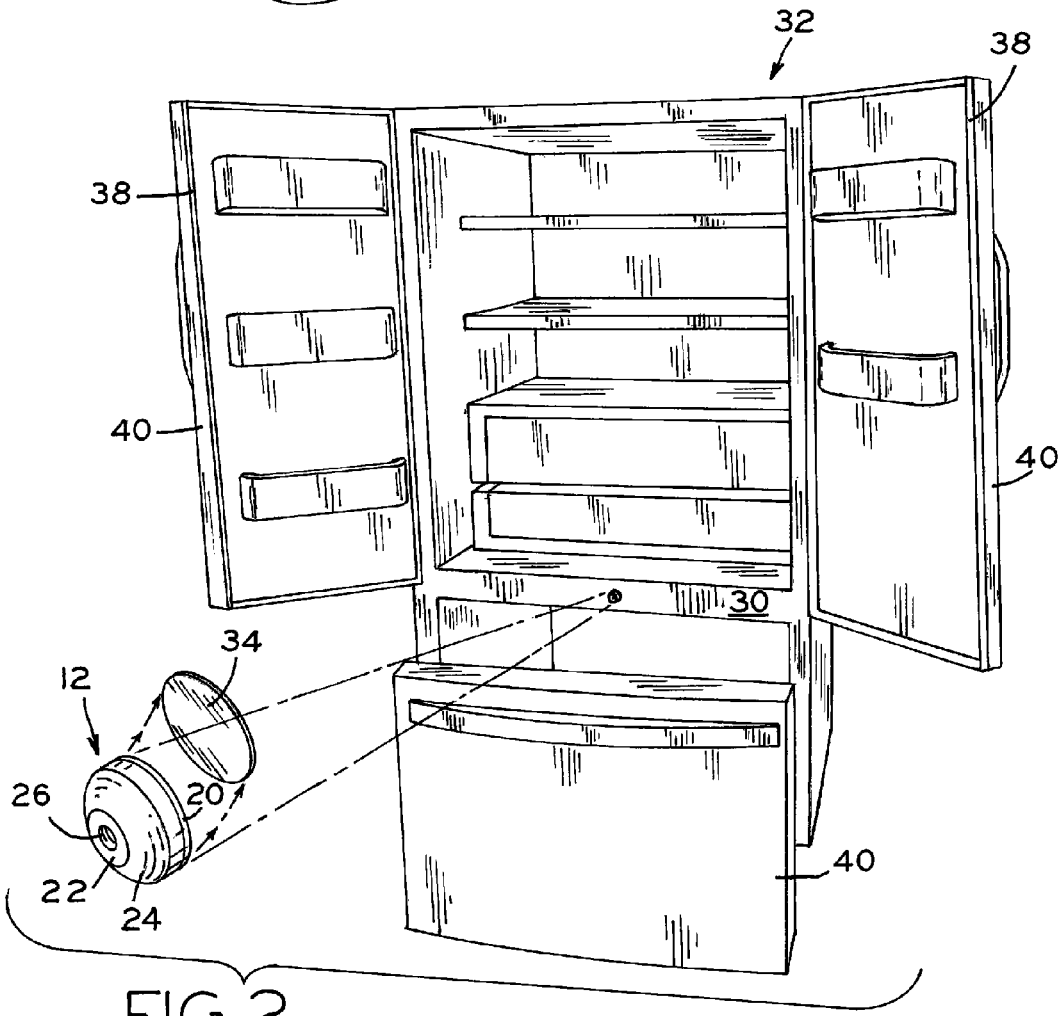
FIG. 2 is a perspective, exploded view illustrating securement of an anchor of the present disclosure to a French door refrigerator having a bottom drawer freezer.

In use, backing 34 can be removed from anchor 12 as illustrated in FIG. 2 so that anchor 12 can be secured to door face 30 of refrigerator 32. Double sided adhesive 20 provides sufficient tensile strength to hold anchor 12 in position throughout the useful life of refrigerator 32. Should removal of anchor 12 be sought, a number of solvents and/or adhesive removal compounds may be utilized in conjunction with application of force to effect removal of anchor 12 from refrigerator 32. As illustrated in FIG. 2, anchor 12 will be positioned such that it is secured to door face 30 and positioned adjacent to door seals 38 (FIG. 5) when doors 40 maintain the closed position. In a conventional manner, door seals 38 extend about the perimeter of each door 40 to seal doors 40 relative to door face 30 when doors 40 are placed in a closed position (see, e.g., FIGS. 4 and 5). Advantageously, using double sided adhesive tape to secure anchor 12 to refrigerator 32 in the manner described herein allows catch 14 to be secured to refrigerator 32 without piercing the frame of refrigerator 32.

While the French door refrigerator illustrated in the drawings includes two classic "doors" which are hingedly connected to the frame of refrigerator 32 and a lower "door" which might be referred to as a "drawer front", for the purposes of this document the term "door", as it is used with reference to refrigerators, generally refers to any external covering that cooperates with the refrigerator frame to selectively effect sealing with a door face of the refrigerator and prevent access to an internal compartment for storing cooled items in the refrigerator.

Figure 3:
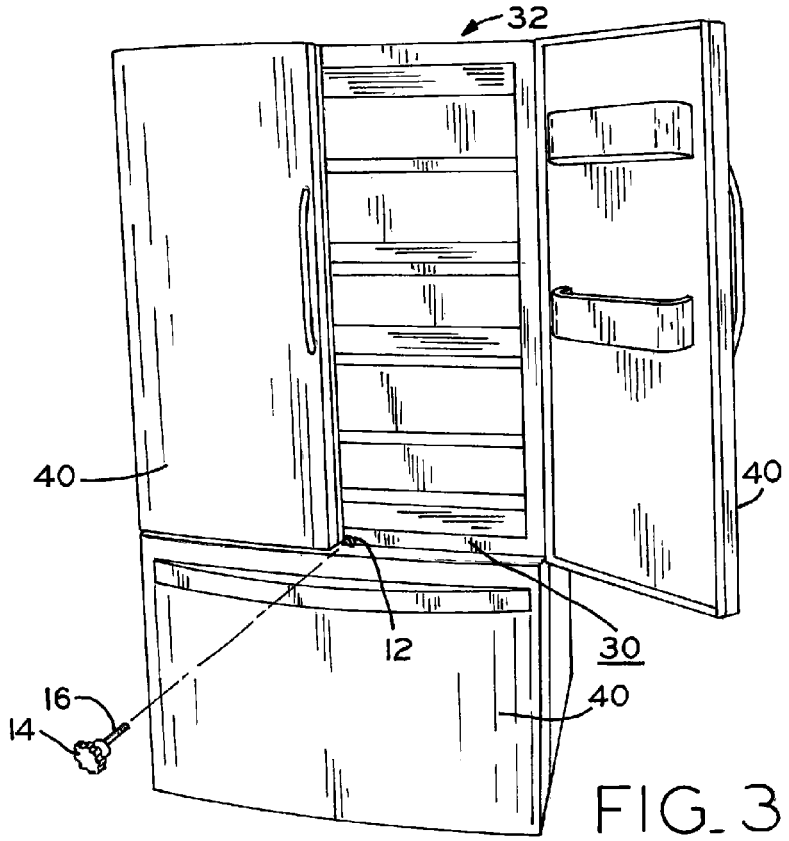
FIG. 3 is a perspective, exploded view of the refrigerator illustrated in FIG. 2, with one door thereof open to better illustrate an anchor secured to a door face of the refrigerator prior to securement of a catch to hold all three refrigerator doors in a closed position.
Figure 4:
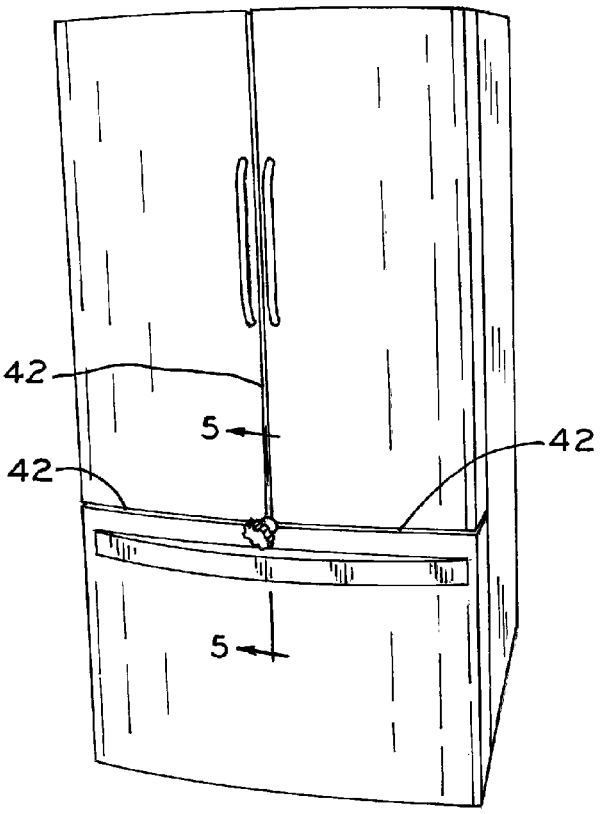
FIG. 4 is a perspective view illustrating the refrigerator lock of the present disclosure positioned to maintain the closed position of all three doors of a French door refrigerator.

With anchor 12 positioned at the intersection of gaps 42, as illustrated in FIGS. 2 and 3, refrigerator door lock 10 is effective to maintain all three doors 40 in a closed position, as illustrated in FIG. 4. With anchor 12 positioned at the intersection of gaps 42, a portion of anchor 12 can be positioned between seals 38 of the two adjacent upper, hindedly connected doors and a portion of anchor 12 can be positioned between each of the seals 38 of the two adjacent upper doors and the seal 38 (FIG. 5) of the lower door 40. Should securement of a fewer number of doors be desired, anchor 12 may be suitably positioned to effect securement of fewer than all of doors 40. For example, anchor 12 could be moved to a position intermediate the left French door 40 and lower door comprising the front of the lower drawer freezer. Similarly, anchor 12 could be moved to a position below the portion of door face 30 intermediate the lower freezer compartment and upper refrigerator compartment. For example, anchor 12 could be secured to a portion of door face 30 which is only engaged by the seal associated with the lower drawer freezer. In exemplary applications, a pair of refrigerator door locks may be utilized with refrigerator 32.

With anchor 12 secured in the position illustrated in FIG. 3, doors 40 may all be moved to a closed position, as illustrated in FIG. 4, with threaded elongate aperture 26 of anchor 12 accessible through gaps 42 formed between doors 40 (see, e.g., FIGS. 4 and 5). Extension 16 is sized to fit through gaps 42 between doors 40 in their closed position, as illustrated in FIG. 5. With doors 40 closed, extension 16 is positioned through gaps 42 formed between doors 40 until distal threaded end 28 of extension 16 encounters threaded elongate aperture 26. Catch 14 and, therefore, extension 16 is thereafter rotated to threadably engage distal threaded end 28 in threaded elongate aperture 26. To facilitate rotation of extension 16 to threadedly engage anchor 12, catch 14 includes a plurality of spaced concave recesses 44 which provide gripping surfaces to facilitate user rotation of catch 14.

Extension 16 is sized such that catch 14 will frictionally engage doors 40 to hold them in the closed position either before, or at the same time as the travel of distal threaded end 28 in threaded elongate aperture 26 is exhausted. In the position illustrated in FIGS. 4 and 5, refrigerator door lock will be operable to maintain all three doors 40 in a closed position because catch 14 will overlap and engage all three doors 40. With catch 14 either directly or indirectly engaging doors 40 as described above, catch 14 will frictionally engage (either directly or indirectly) doors 40; however, because such frictional engagement is caused solely by the securement of catch 14 to anchor 12, catch 14 is considered to be secured relative to doors 40 solely by way of its securement to anchor 12.

As illustrated in FIG. 5, boss 36 of catch 14 may include an outer radius sized whereby boss 36 engages doors 40 to lock doors 40 into a closed position. In alternative embodiments, boss 36 will more closely approximate the outer diameter of extension 16 so that boss 36 will be positionable within gaps 42 together with extension 16. In such an embodiment, the more radially outward head of catch 14 will engage doors 40 to hold them in the locked position.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A refrigerator door lock for selectively locking at least one door of a refrigerator into a closed position in which a door seal of the at least one door maintains sealing engagement with a door face of the refrigerator and access to an internal compartment for storing cooled items is prevented, said refrigerator door lock comprising:

an anchor including an outer periphery sized to fit on the door face of the refrigerator adjacent to the door seal of the at least one door of the refrigerator when the at least one door of the refrigerator maintains the closed position and the door seal of the at least one door engages the door face of the refrigerator, the anchor having a refrigerator fastener operable to selectively secure said anchor to the door face of the refrigerator in a chosen position, wherein the door seal defines a gap between the at least one door and the door face when the at least one door maintains the closed position and wherein the anchor is at least partially located in the gap when the at least one door maintains the closed position;

a catch;

an extension extending from said catch, said extension selectively securable to said anchor in a secured position; and said catch sized to overlap the at least one door of the refrigerator when said catch is secured to said anchor and said anchor is secured to the door face of the refrigerator adjacent to the door seal of the at least one door when the at least one door of the refrigerator maintains the closed position and the door seal of the at least one door engages the door face of the refrigerator, said extension having a length between said catch and said anchor when said extension is secured to said anchor, said length sized so that, with said anchor secured to the door face adjacent to the door seal of the at least one door and said at least one door of the refrigerator in the closed position and said extension secured to said anchor, said catch engages the at least one door of the refrigerator to hold it in the closed position.

2. The refrigerator door lock of claim 1, wherein said refrigerator fastener comprises an adhesive.

3. The refrigerator door lock of claim 2, wherein said adhesive comprises an acrylic adhesive.

4. The refrigerator door lock of claim 2, wherein said adhesive comprises an acrylic adhesive coated on both sides of a core.

5. The refrigerator door lock of claim 4, wherein said core is formed of a solid acrylic.

6. The refrigerator door lock of claim 4, wherein said core is formed of a foamed acrylic.

7. The refrigerator door lock of claim 1, wherein said anchor comprises a threaded aperture and said extension comprises a distal threaded end, said distal threaded end of said extension cooperating with said threaded aperture of said extension to selectively secure said extension and thereby said catch to said anchor.

8. The refrigerator door lock of claim 1, wherein said catch comprises a generally circular perimeter perpendicular to a longitudinal axis of said catch, said generally circular perimeter including a plurality of spaced concave recesses, said spaced concave recesses provide gripping surfaces to facilitate a user rotation of said catch.

9. The refrigerator door lock of claim 1, wherein said catch comprises a generally circular perimeter perpendicular to a longitudinal axis of said catch, said generally circular perimeter defining a diameter of about 2½ inches.

10. The refrigerator door lock of claim 1, wherein said at least one door comprises a pair of adjacent doors wherein said extension defines a cross-section perpendicular to a longitudinal axis of said extension throughout the length of said extension, the cross-section of the extension sized to extend between at least one gap formed between the pair of adjacent doors when the pair of doors maintains the closed position.

11. The refrigerator door lock of claim 1, wherein said extension is circular in a cross section perpendicular to a longitudinal axis of said extension throughout said length of said extension, said extension having a perimeter defined by a diameter of about ⅜ inches.

12. The refrigerator door lock of claim 1, wherein said anchor defines a distal fastener surface from which said refrigerator fastener extends and an opposite proximal surface, said anchor tapering from said distal fastener surface to said proximal surface, said anchor defining a height between the distal fastener surface and the opposite proximal surface of about 7⁄16 inches.

13. A method of securing at least one door of a refrigerator against opening when the refrigerator is in transit, the method comprising:

securing an anchor, the anchor including an outer periphery sized to fit on a door face of the refrigerator adjacent to a door seal of the at least one door of the refrigerator when the at least one door of the refrigerator maintains a closed position and the door seal of the at least one door engages the door face of the refrigerator, the anchor having a refrigerator fastener operable to selectively secure said anchor to the door face of the refrigerator in a chosen position wherein the door seal defines a gap between the at least one door and the door face when the at least one door maintains the closed position and wherein the anchor is at least partially located in the gap when the at least one door maintains the closed position, the refrigerator so that the anchor is adjacent to a seal of at least one door of the refrigerator when the at least one door of the refrigerator maintains the closed position in which the door seal of the at least one door maintains sealing engagement with the door face of the refrigerator and access to an internal compartment for storing cooled items is prevented; and securing a catch, the catch having an extension extending from the catch, the extension selectively securable to the anchor in a secured position, the catch sized to overlap the at least one door of the refrigerator when said catch is secured to said anchor and said anchor is secured to the door face of the refrigerator adjacent to the door seal of the at least one door when the at least one door of the refrigerator maintains the closed position and the door seal of the at least one door engages the door face of the refrigerator, said extension having a length between said catch and said anchor when said extension is secured to said anchor, said length sized so that, with said anchor secured to the door face adjacent to the door seal of the at least one door and said at least one door of the refrigerator in the closed position and said extension secured to said anchor, said catch engages the at least one door of the refrigerator to hold it in the closed position, to the anchor so that, with the at least one door of the refrigerator maintaining the closed position, the catch overlaps the at least one door of the refrigerator and engages the at least one door of the refrigerator to hold it in the closed position, the catch secured relative to the at least one door of the refrigerator solely by way of its securement to the anchor.

14. The method of claim 13, wherein the at least one door comprises a pair of adjacent doors, and wherein said anchor comprises a catch fastener, said step of securing the anchor to the refrigerator comprises the step of securing the anchor to the refrigerator so that the catch fastener is accessible when the pair of adjacent doors of the refrigerator maintain the closed position.

15. The method of claim 13, wherein the refrigerator comprises a French door refrigerator with a bottom freezer, wherein the at least one door of the refrigerator comprises a pair of adjacent French doors and a door of the bottom freezer of the French door refrigerator, and wherein said anchor comprises a catch fastener, said step of securing the anchor to the refrigerator comprises the step of securing the anchor to the refrigerator so that the catch fastener is accessible when the pair of adjacent French doors and the door of the bottom freezer maintain the closed position.

16. The method of claim 13, wherein said step of securing the catch to the anchor comprises the step of securing the extension extending from the catch to the anchor.

17. The method of claim 16, wherein said step of securing the extension to the anchor comprises the step of threading a threaded distal end of the extension into a threaded aperture formed in the anchor.

18. The method of claim 14, wherein the pair of adjacent doors define a gap therebetween when the pair of adjacent doors maintain the closed position, wherein said catch fastener comprises a threaded aperture formed in the anchor, and wherein the step of securing the catch to the anchor comprises the steps of;

closing the pair of adjacent doors;

positioning the extension extending from the catch into the gap between the pair of adjacent doors; and threading a threaded distal end of the extension into said threaded aperture formed in the anchor so that the catch overlaps the pair of adjacent doors of the refrigerator to hold them in the closed position.

19. The method of claim 15, wherein the pair of adjacent French doors and the door of the bottom freezer of the French door refrigerator define a gap therebetween when the pair of adjacent French doors and the door of the bottom freezer maintain the closed position, wherein said catch fastener comprises a threaded aperture formed in the anchor, and wherein the step of securing the catch to the anchor comprises the steps of:

closing the pair of adjacent French doors and the door of the bottom freezer;

positioning the extension extending from the catch into the gap between the pair of adjacent French doors and the door of the bottom freezer; and threading a threaded distal end of the extension extending from the catch into said threaded aperture formed in the anchor so that the catch overlaps the pair of adjacent French doors and the door of the bottom freezer of the refrigerator to hold them in the closed position.

20. The method of claim 13, wherein said step of securing the anchor to the refrigerator comprises the step of securing the anchor to the refrigerator with an adhesive.

* * * * *